US011771187B2

(12) United States Patent
Nion

(10) Patent No.: US 11,771,187 B2
(45) Date of Patent: Oct. 3, 2023

(54) SUNSHADE FOR OUTDOOR PUBLIC SPACE AND OUTDOOR PUBLIC SPACE HAVING SUCH A SUNSHADE

(71) Applicant: JCDecaux SA, Neuilly sur Seine (FR)

(72) Inventor: Jean Francois Nion, Los Angeles, CA (US)

(73) Assignee: JCDecaux SA, Neuilly sur Seine (FR)

( * ) Notice: Subject to any disclaimer, the term of this patent is extended or adjusted under 35 U.S.C. 154(b) by 7 days.

(21) Appl. No.: 17/082,841

(22) Filed: Oct. 28, 2020

(65) Prior Publication Data

US 2022/0125170 A1 Apr. 28, 2022

(51) Int. Cl.
*A45B 23/00* (2006.01)
*E04H 1/12* (2006.01)

(52) U.S. Cl.
CPC ..... *A45B 23/00* (2013.01); *E04H 1/1211* (2013.01); *A45B 2023/0093* (2013.01); *A45B 2200/1027* (2013.01)

(58) Field of Classification Search
CPC ..... E04H 1/1211; E04H 15/58; A45B 2023/0093; A45B 23/00; A45B 2023/0012; A45B 2200/1027
See application file for complete search history.

(56) References Cited

U.S. PATENT DOCUMENTS 2,537,787 A * 1/1951 Ramsay ..... E04H 1/1211 135/96
5,542,203 A * 8/1996 Luoma ..... G09F 9/3026 340/908
5,947,139 A * 9/1999 Lebrecht ..... E04H 15/003 135/132
6,750,829 B2 * 6/2004 Luoma ..... G09F 9/33 345/84
9,645,611 B2 * 5/2017 Chen ..... F21V 33/008
2006/0260161 A1 * 11/2006 Hamilton ..... G09F 13/04 40/541
2012/0067388 A1 3/2012 Zummach
2018/0247575 A1 * 8/2018 Konde ..... G06Q 30/0246
2019/0032339 A1 * 1/2019 Matturro ..... E04H 15/005

FOREIGN PATENT DOCUMENTS

CN 2617849 Y 5/2004
CN 204163428 U 2/2015
CN 104783536 A 7/2015
(Continued)

OTHER PUBLICATIONS

Glasscon; Premium Architectural Building Skins; Brise Soleil & Architectural Solar Shadng; pp. 1-21; Glasscon GmbH; Eschborn, Germany.

(Continued)

*Primary Examiner* — Noah Chandler Hawk
(74) *Attorney, Agent, or Firm* — von Briesen & Roper, s.c.

(57) ABSTRACT

A sunshade for an outdoor public space, having a pane made from an at least partially opaque material and a pivotal mount adapted to be fixed to the ground and pivotally supporting the pane for rotation about a vertical axis of rotation. The pane is of elongate shape, extending longitudinally, parallel to the axis of rotation, between a lower end and an upper free end. The pane has a width and a thickness smaller than the width.

23 Claims, 5 Drawing Sheets

(56) References Cited

FOREIGN PATENT DOCUMENTS

| | | | |
|---|---|---|---|
| CN | 210977229 | U | 7/2020 |
| DE | 29913252 | U1 | 8/2000 |
| FR | 3042302 | B1 | 11/2017 |
| GB | 2450674 | A | 7/2009 |
| GB | 2513857 | A | 11/2014 |

OTHER PUBLICATIONS

Extended European Search Report related to Application No. 21204145.
3; dated Mar. 14, 2022.

* cited by examiner

SUNSHADE FOR OUTDOOR PUBLIC SPACE AND OUTDOOR PUBLIC SPACE HAVING SUCH A SUNSHADE

TECHNICAL FIELD

The present disclosure relates to sunshades for public spaces and to outside public spaces having such sunshades.

More particularly, the present disclosure concerns sunshades useful to protect people from the sun in public spaces such as, for example, public transportation stations. As used in the present, "public transportation station" means a place where public transportation vehicles regularly stop to let users get on and off the public transportation vehicles. Said public transportation vehicles may be, for example, buses, trams, trolleys, trains, above ground metros, car share stations, micro-mobility stations or similar.

PRIOR ART

Public transportation stations, such as bus or trolley pick-up and discharge locations, may be equipped with shelters or the like which protect users from bad weather and from the sun. Many public transportation stations, though, are not equipped with shelters, especially in areas having low rainfall or in locations having limited numbers of users, narrow sidewalks or in other spaces which have physical or technical challenges related to the installation of shelters. In these situations, the users waiting for public transportation may be subjected to exposure from the sun, resulting in adverse impacts to their well-being and health.

Similar situations can be found in other public spaces.

OBJECTS

One purpose of the present disclosure is to improve this situation.

To this end, one object of the present disclosure is a sunshade for an outdoor public space having a bottom surface, said sunshade including:

- a pane adapted to provide at least partial shade from sunlight;
- a pivotal mount adapted to be fixed to the bottom surface of the outdoor public space and pivotally supporting said pane so that said pane is orientable by rotation about an axis of rotation which is substantially vertical when said pivotal mount is fixed to the bottom surface, wherein said pane is of substantially elongate shape, with a height extending longitudinally, substantially parallel to the axis of rotation, between a lower end and an upper end, and wherein said pane has a width and a thickness which are perpendicular to the axis of rotation, the greatest thickness being smaller than the greatest width.

The persons present in the public space may thus protect themselves from the sun in the shade created by the sunshade. This protection is made particularly efficient as the pane may be rotated and thus orient the sunshade to provide additional shade as desired. Further, the sunshade can be limited in its horizontal dimension, and thus limit the obstruction, if any, in the public space.

Further embodiments of the sunshade may have one or several of the following features and any combination thereof:

- said width is comprised between 32 cm and 140 cm perpendicular to said axis of rotation;
- said width is comprised between 50 and 70 cm;

- said upper end of said pane at a height comprised between 130 cm and 300 cm above the bottom surface of the outdoor public space;
- said upper end of said pane is at a height comprised between 180 cm and 250 cm above the bottom surface of the outdoor public space;
- said outdoor public space includes a public transportation station and said sunshade is installed at said public transportation station;
- said sunshade further has an inclined wall which extends upwards from substantially said upper end of said pane;
- said inclined wall has an upper face equipped with at least one photovoltaic panel;
- said pane has a first face and a second face opposite to said first face, said second face having equipment usable by users of the sunshade;
- said sunshade has an inclined wall which extends upwards from said second face of the pane, substantially at said upper end of said pane;
- said equipment includes a seat adapted to support a user sitting on said seat;
- the first face of the pane has an additional seat adapted to support a user sitting on said additional seat;
- said equipment includes at least one electrical device;
- said at least one electrical device is chosen in the group comprising: a display, an electrical charger for mobile electronic devices;
- said sunshade further includes at least one photovoltaic panel, at least one battery and an electrical system electrically supplied from said at least one photovoltaic panel through said at least one battery;
- said electrical system includes lighting;
- said electrical system includes a motorized orientation apparatus adapted to orient the sunshade to face the sun;
- said electrical system includes a display;
- said display is a digital display and said electrical system further includes a processing unit and a communication interface, said processing unit controlling the communication interface and the display, said processing unit being adapted to communicate, via the communication interface, with a remote source of information to retrieve information for displaying said information on the display;
- said sunshade is installed at a public transportation station and said information includes timing of arrival and/or departure of public transportation vehicles at said public transportation station;
- the sunshade further has a wall which extends from substantially said upper end of said pane and which is adapted to protect a user from weather, said wall being either substantially horizontal or inclined;
- the sunshade further includes lateral walls extending from said pane under said wall to protect a user from weather;
- the pane is opaque;
- said upper end of said pane is free.

Another object of the present disclosure is an outdoor public space having a sunshade as defined above, said pivotal mount being fixed to the bottom surface and said axis of rotation extending substantially vertically.

In embodiments of the above outside public space, one may further use one or several of the following features and any combination thereof:

- said outdoor public space includes a public transportation station;

the outdoor public space further includes a bench fixed to the ground in the vicinity of the sunshade;

said bench is shaped substantially as an arc of circle centered on said axis of rotation.

BRIEF DESCRIPTION OF THE DRAWINGS

Other features and advantages will appear from the following description of several embodiments, given by way of non-limiting examples, with reference to the drawings.

In the drawings.

MORE DETAILED DESCRIPTION

In the various drawings, the same references designate identical or similar elements.

Figure 1:
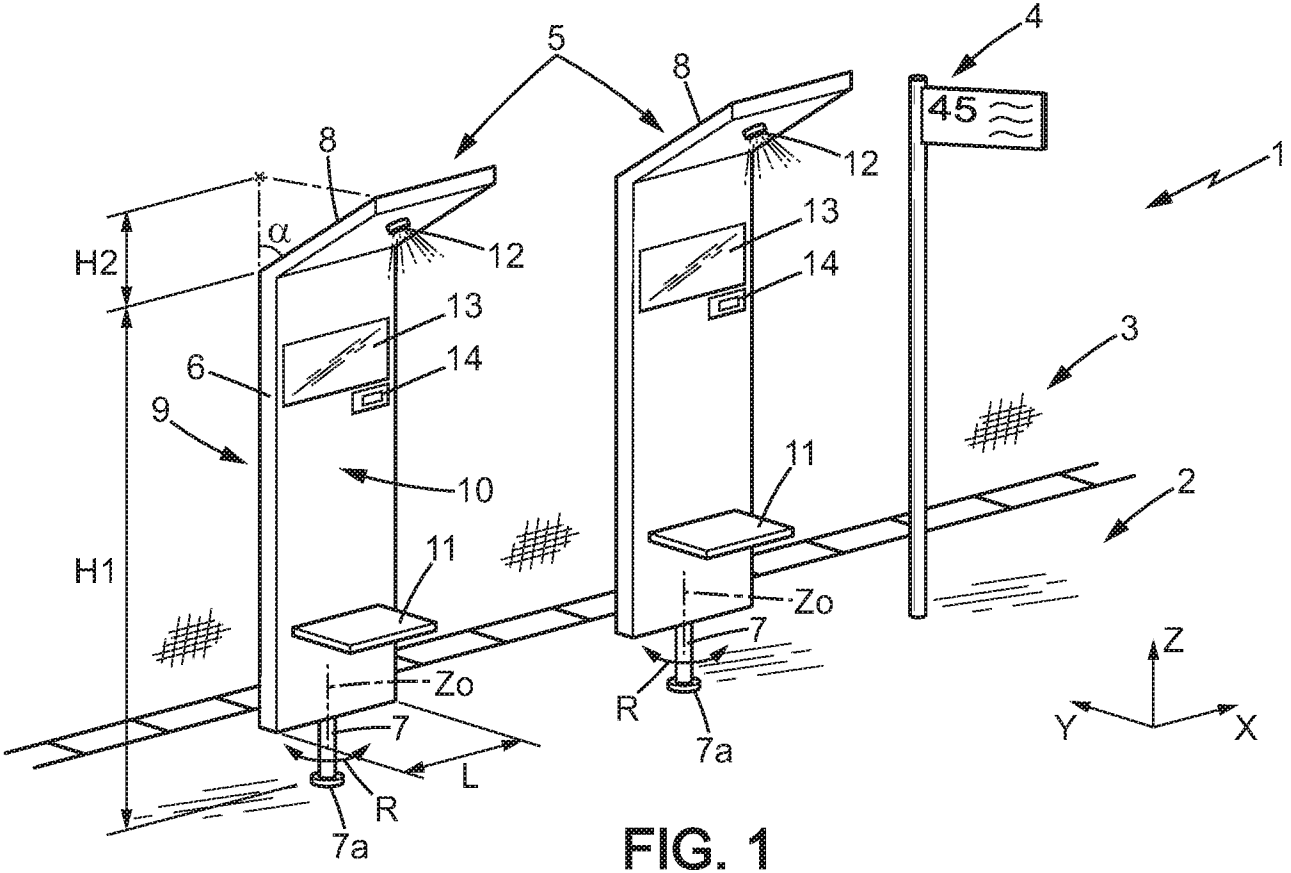
FIG. 1 shows an example of outdoor public space having sunshades according to a first embodiment.

FIG. 1 shows an outdoor public space 1, situated in a public place, for instance being part of a sidewalk 2 beside street 3.

Outdoor public space 1 may be or include for instance a public transportation station as defined above, for instance a bus station.

The public transportation station may include for instance a signage 4 marking the place of the station for public transportation vehicles to stop.

Outdoor public space 1 includes one or more sunshades 5, for shading users who are waiting for public transportation vehicles at the public transportation station.

Figure 2:
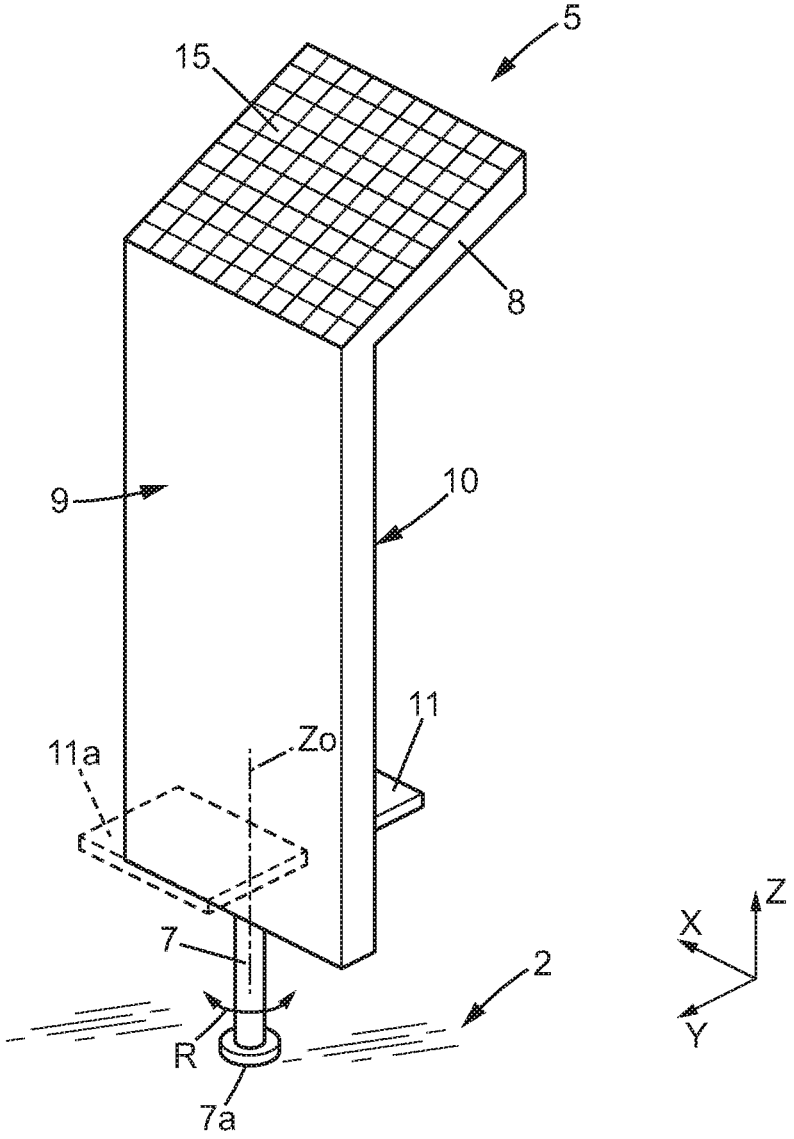
FIG. 2 is perspective view of one of the sunshades of the outdoor public space of FIG. 1.

Each sunshade 5, as illustrated by FIGS. 1 and 2, includes a pane 6 which blocks sunlight at least partially. Pane 6 may be opaque. For instance, pane 6 may be made from an opaque solid material or from an opaque structured material.

In a variant, pane 6 may let through part of the sunlight, for instance less than 50% of the incident light intensity. In this variant, pane 6 may be made from a structured opaque material having holes which let through part of the sunlight, or from a transparent colored material or from a translucent material.

Pane 6 may be rigidly mounted on a foot 7 which itself is pivotally supported by a pivotal mount 7*a* fixed to the ground, so that said pane 6 and foot are orientable by rotation about an axis of rotation Z0 which is substantially vertical. In a variant, pane 6 could be orientable and foot 7 could be fixed.

More generally speaking, pane 6 is mounted (directly or indirectly) on a pivotal mount 7*a* which is fixed (directly or indirectly) to the ground and which is pivotally supporting said pane 6 so that said pane is orientable by rotation about substantially vertical axis of rotation Z0.

Pivotal mount 7*a* may be installed in the ground, for instance in the sidewalk 2, as shown.

Alternatively, pivotal mount 7*a* may be adapted to mount pane 6 on a pole which is fixed to the ground, such as a pole from signage 4 or from a lighting or from a pedestrian light or from a bus shelter, etc. Pivotal mount 7*a* may simply be part of the pole, on which pane 6 is adapted to pivot around axis of rotation Z0.

When pane 6 is mounted on the pole, such pole may guide pane 6 in rotation on all the height of pane 6. For instance, the pole could be fixed and pane 6 could include a tubular coupling fitted on the pole, thus permitting rotation. In that example, the fixed pole constitutes said pivotal mount.

In a variant, pane 6 could be mounted to the pole through bearings mounted on the pole at one or several specific heights to guide pane 6 in rotation.

In one example, pane 6 may be freely rotatable on pivotal mount 7*a*.

In another example, pivotal mount 7*a* may include a brake, to brake rotation movements of pane 6 in case of wind for instance and/or to avoid the fall of a user leaning on pane 6.

In still another example pivotal mount 7*a* may include a brake or lock, to stop rotation movements of pane as long as an actuation member (not shown) is not actuated by a user. Such actuation member might be a pedal or a handle actuatable by a user.

Pivotal mount 7*a* may also include a mechanism to replace the pane automatically to a predetermined position, for instance a certain time after orientation by a user.

In still another example pivotal mount 7*a* may include a motorized mechanism as will be explained below with regard to the second embodiment.

Pane 6 is of substantially flat and elongate shape, extending longitudinally, substantially parallel to a vertical axis Z, between a lower end connected to the pivotal mount and an upper end.

The upper end of pane 6 is a free end in the example disclosed in the drawings.

Said upper end of said pane may be at a height H1 comprised between 130 cm and 300 cm above the ground. The lower values of this range are usable especially when the pane is equipped with a seat as will be explained below. In one example of preferred embodiment, said height H1 may be comprised between 180 cm and 250 cm. For instance, height H1 may be of about 210 cm.

The lower end of pane 6 may be at a height of a few tens of centimeters above the ground, for instance 20 to 50 cm, which helps limit the obstruction by sunshade 1 of the sidewalk.

Pane 6 also extends laterally on certain width L parallel to a horizontal axis X. Width L may be comprised between 32 cm and 140 cm, in particular between 50 and 70 cm. For instance, width L may be of about 60 cm.

Rotation axis Z0 may be substantially in the middle of width L.

Pane 6 has also a certain thickness parallel to a second horizontal axis Y perpendicular to axis X. Such thickness may be constant on all the extent of pane 6 (flat pane 6) or not. Pane 6 might have for instance a profiled shape similar to an airplane wing. Typical values for the thickness of pane 6 may be of a few centimeters, for instance 1 to 10 cm. Generally, pane 6 is shaped so that, when considering a horizontal cross-section thereof, its greatest thickness within this horizontal cross-section is smaller than its greatest width.

Sunshade 1 may further have an inclined wall 8 which extends upwards from said upper end of pane 6.

Inclined wall 8 may extend vertically on a height H2 over the upper end of pane 6. H2 may be for instance comprised between 30 and 60 cm. In one example, H2 may be about 45 cm.

Inclined wall 8 may be substantially flat and may form an angle α of for instance 30 to 60 degrees with vertical plane XZ. In one example, angle α may be of about 45 degrees.

Inclined wall 8 has an upper face which, in one example, may be equipped with at least one photovoltaic panel 15.

Pane 6 has a first face 9, adapted to be oriented toward the sun, and a second face 10 opposite to said first face. Said inclined wall 8 extends from said second face.

In one example, first face 9 of pane 6 may bear for instance advertisement or other information, or decoration, or branding, or city public service announcement or additional photovoltaic panel(s) (not shown).

Second face 10 of the pane may have equipment usable by users of the sunshade.

Such equipment may include a seat 11 adapted to support a user sitting on said seat. Seat 11 may be mounted to pane 6, or for instance to foot 7. Seat 11 may be fixed in use position or may be foldable between the use position as shown and a vertical, retracted position (not shown).

In a variant, first face 9 of pane 6 may have an additional seat 11*a* (FIG. 2) adapted to support a user sitting on said additional seat. Additional seat 11*a* may be similar to seat 11 as described above. Seat 11*a* may be used by users willing to seat in the sun, for instance in winter.

In another example, the above-mentioned equipment of the second face 10 of pane 6 may also include at least one electrical device (in addition or alternatively to seat 11).

In one example, said at least one electrical device may be chosen in the group comprising: a display 13; an electrical charger 14 for mobile electronic devices; an emergency call system (for instance, having a call button, a microphone and a loudspeaker).

The sunshade 5 may also include a lighting 12, for instance in the lower face of inclined wall 8.

The above display 14, or an additional display, could also be located in the lower face of inclined wall 8.

Figure 3:
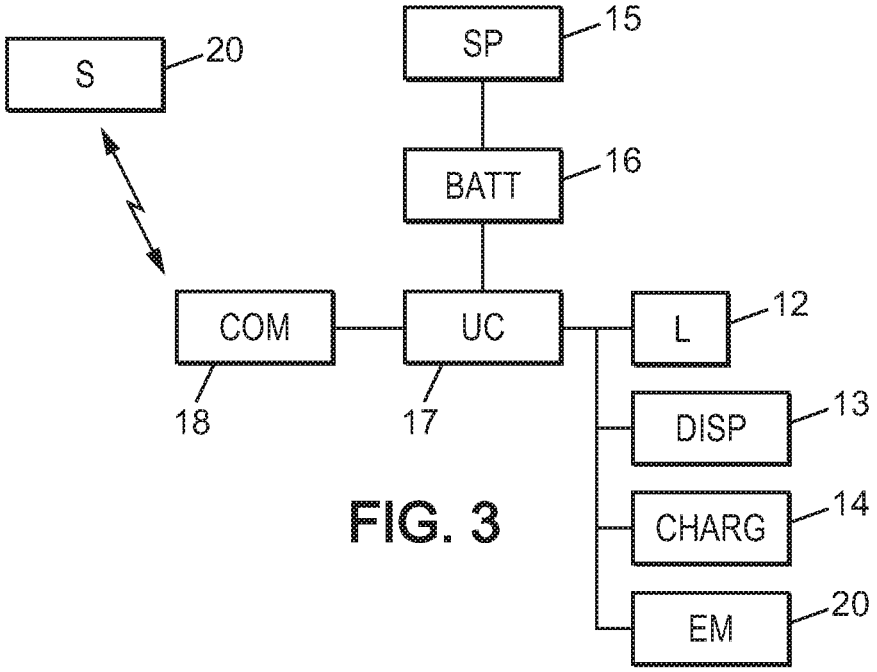
FIG. 3 is a block diagram showing some of the components in the sunshade of FIG. 2.

As illustrated in FIG. 3, sunshade 5 may include at least one battery 16 (BATT) supplied by photovoltaic panel(s) 15 (SP), at least one battery and an electrical system which is electrically supplied from said at least one photovoltaic panel 15 through said at least one battery 16.

Said electrical system may include an electronic processing unit 17 (UC) such as a microcontroller or similar unit, which controls electrical devices such as, for example:

- said lighting 12 (L), which is controlled to produce light only at night; and/or
- said display 13 (DISP), for instance a digital display; and/or
- said charger 14 (CHARG); and/or
- a communication interface 18 (COM), able to communicate, wirelessly or not, with a remote source of information 20 (S) such as at least one server; and/or
- said emergency call system 20*a* (EM) including for instance a call button, a microphone, a loudspeaker and a communication interface adapted to communicate with a distant security center.

The electrical system could also be connected to an external power source (not shown) such as a public electricity network.

Processing unit 17 may be adapted to communicate, via communication interface 18, with remote source of information 20 to retrieve information, and processing unit 17 controls display 13 to display said information.

Said information may include:

- timing of arrival and/or departure of public transportation vehicles at the public transportation station; and/or
- general information; and/or
- advertisement.

Figure 4:
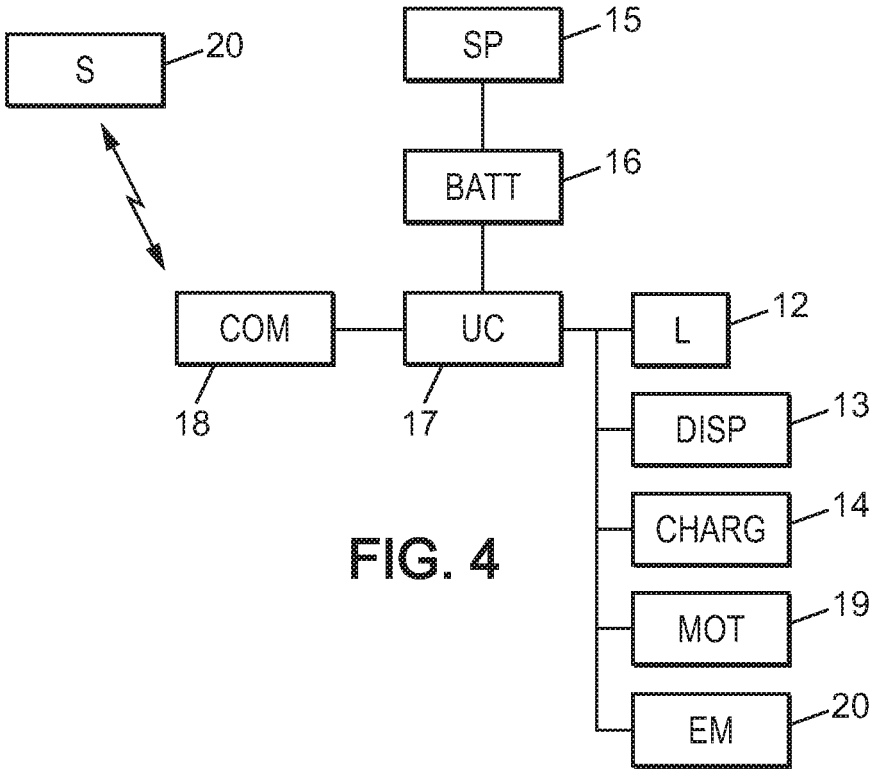
FIG. 4 is a block diagram similar to FIG. 3, in a second embodiment.

In the second embodiment, illustrated by FIG. 4, the disclosure above regarding the first embodiment applies, and said electrical system may further include a motorized orientation apparatus 19 (MOT) which equips for instance pivotal mount 7*a* and which is controlled by processing unit 17 to orient the sunshade 5 so that first face 9 of pane 6 always faces the sun during the day. Orientation of sunshade 5 may be controlled by processing unit 17 for instance based on programmed orientations as a function of time.

Figure 5:
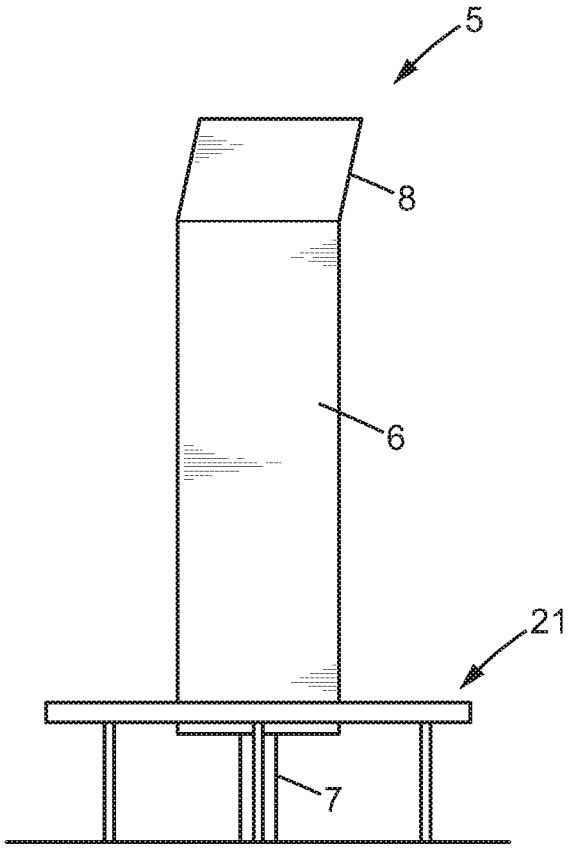
FIGS. 5 and 6 are respectively a schematic side view and a schematic top view of a third embodiment.
Figure 6:
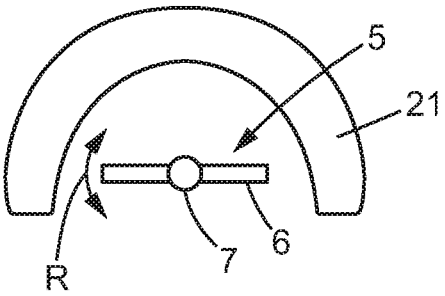

In the third embodiment, illustrated by FIGS. 5-6, sunshade 5 may be combined with a bench 21 which is fixed to the ground, for users to sit in the shade of sunshade 5. Bench 21 may be shaped substantially as an arc of circle centered on said axis of rotation Z0 and extending for instance on 90 to 270 degrees around axis Z0. Otherwise, all description of the first and second embodiments is applicable to the third embodiment.

Figure 7:
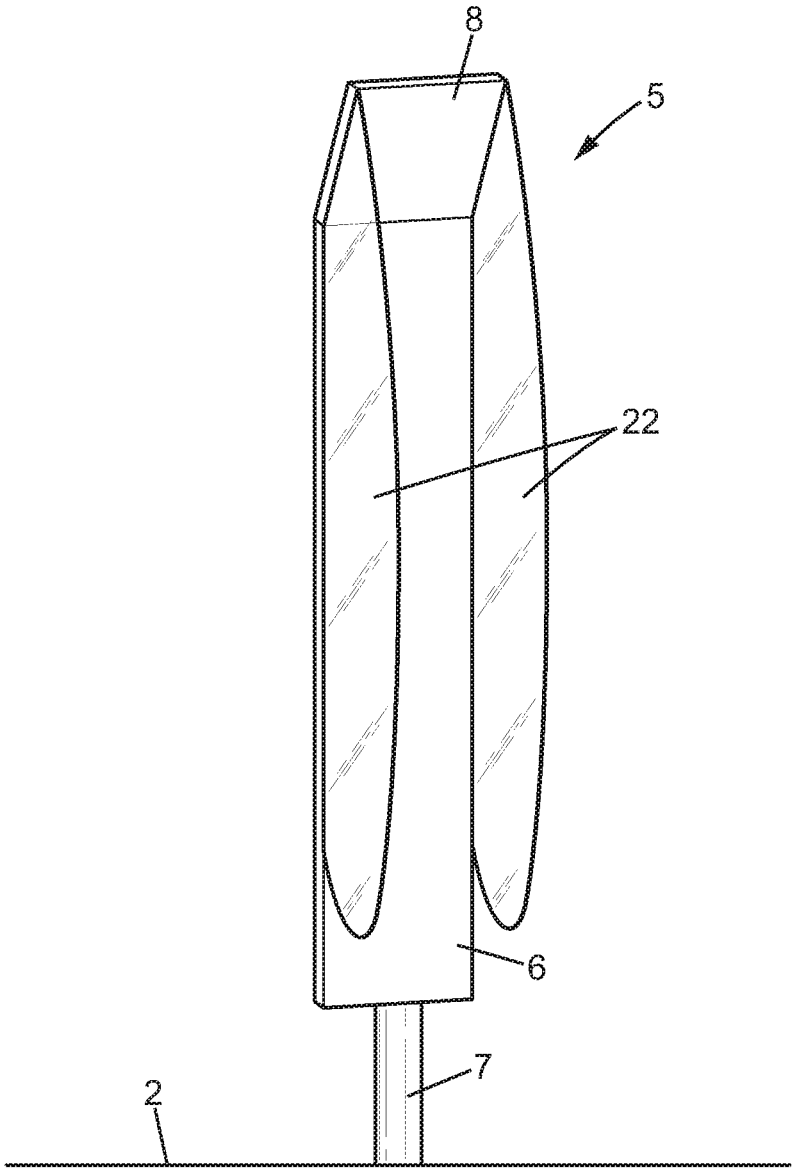
FIG. 7 is a schematic perspective view of a fourth embodiment.

In the fourth embodiment, illustrated by FIG. 7, inclined wall 8 is combined with lateral walls 22 which extend downward from inclined wall 8 and rearward of pane 6. Inclined wall 8, in combination with lateral walls 22, protects a user situated under said wall 8 against bad weather conditions such as rain, wind, snow or hail. Inclined wall 8 may be replaced by a substantially horizontal wall. Otherwise, all description of the first, second and third embodiments is applicable to the fourth embodiment.

The invention claimed is:

1. A sunshade for an outdoor public space having a ground, said sunshade including:

- a pane adapted to provide at least partial shade from sunlight;
- a pivotal mount adapted to be fixed to the ground and pivotally supporting said pane so that said pane is orientable by rotation about an axis of rotation which is substantially vertical when said pivotal mount is fixed to the ground, wherein said pane is of substantially elongate shape, with a height extending longitudinally, substantially parallel to the axis of rotation, between a lower end and an upper end, wherein said pane has a width and a thickness which are perpendicular to the axis of rotation, the greatest thickness being smaller than the greatest width, wherein said sunshade is configured to enable a user standing on the ground to come in immediate vicinity to said pane, the sunshade further having an inclined wall which extends upwards from substantially said upper end of said pane.

2. The sunshade according to claim 1, wherein said pivotal mount includes a brake adapted to brake rotation movements of said pane.

3. The sunshade according to claim 2, wherein said brake brakes rotation movements of said pane with a braking force adapted to avoid fall of a user leaning on said pane.

4. The sunshade according to claim 1, wherein said width is comprised between 32 cm and 140 cm perpendicular to said axis of rotation.

5. The sunshade according to claim 1, wherein said width is comprised between 50 and 70 cm.

6. The sunshade according to claim 1, wherein said upper end of said pane is at a height comprised between 130 cm and 300 cm over the ground when said pivotal mount is fixed to the above the ground.

7. The sunshade according to claim 1, wherein said upper end of said pane is at a height comprised between 180 cm and 250 cm over the ground.

8. The sunshade according to claim 1, wherein said outdoor public space includes a public transportation station and said sunshade is installed at said public transportation station.

9. The sunshade according to claim 1, wherein said inclined wall has an upper face equipped with at least one photovoltaic panel.

10. The sunshade according to claim 1, wherein the pane is opaque.

11. The sunshade according to claim 1, wherein said upper end of said pane is free.

12. A sunshade for an outdoor public space having a ground, said sunshade including:

a pane adapted to provide at least partial shade from sunlight;

a pivotal mount adapted to be fixed to the ground and pivotally supporting said pane so that said pane is orientable by rotation about an axis of rotation which is substantially vertical when said pivotal mount is fixed to the ground, wherein said pane is of substantially elongate shape, with a height extending longitudinally, substantially parallel to the axis of rotation, between a lower end and an upper end, wherein said pane has a width and a thickness which are perpendicular to the axis of rotation, the greatest thickness being smaller than the greatest width, wherein said sunshade is configured to enable a user standing on the ground to come in immediate vicinity to said pane, wherein said pane has a first face and a second face opposite to said first face, said second face having equipment usable by users of the sunshade, wherein said equipment includes a seat adapted to support a user sitting on said seat.

13. The sunshade according to claim 12, wherein said sunshade has an inclined wall which extends upwards from said second face, substantially at said upper end of said pane.

14. The sunshade according to claim 12, wherein the first face of the pane has an additional seat adapted to support a user sitting on said additional seat.

15. A sunshade for an outdoor public space having a ground, said sunshade including:

a pane to provide at least partial shade from sunlight;

a pivotal mount adapted to be fixed to the ground and pivotally supporting said pane so that said pane is orientable by rotation about an axis of rotation which is substantially vertical when said pivotal mount is fixed to the ground, wherein said pane is of substantially elongate shape, with a height extending longitudinally, substantially parallel to the axis of rotation, between a lower end and an upper end, wherein said pane has a width and a thickness which are perpendicular to the axis of rotation, the greatest thickness being smaller than the greatest width, wherein said sunshade is configured to enable a user standing on the ground to come in immediate vicinity to said pane, wherein said pane has a first face and a second face opposite to said first face, said second face having equipment usable by users of the sunshade, wherein said equipment includes at least one electrical device.

16. The sunshade according to claim 15, wherein said at least one electrical device is chosen in the group comprising: a display, an electrical charger for mobile electronic devices and an emergency call system.

17. A sunshade for an outdoor public space having a ground, said sunshade including:

a pane adapted to provide at least partial shade from sunlight;

a pivotal mount adapted to be fixed to the ground and pivotally supporting said pane so that said pane is orientable by rotation about an axis of rotation which is substantially vertical when said pivotal mount is fixed to the ground, wherein said pane is of substantially elongate shape, with a height extending longitudinally, substantially parallel to the axis of rotation, between a lower end and an upper end, wherein said pane has a width and a thickness which are perpendicular to the axis of rotation, the greatest thickness being smaller than the greatest width, wherein said sunshade is configured to enable a user standing on the ground to come in immediate vicinity to said pane, the sunshade further including at least one photovoltaic panel, at least one battery and an electrical system electrically supplied from said at least one photovoltaic panel through said at least one battery.

18. The sunshade according to claim 17, wherein said electrical system includes a lighting.

19. The sunshade according to claim 17, wherein said electrical system includes a motorized orientation apparatus adapted to orient the sunshade to face the sun.

20. The sunshade according to claim 17, wherein said electrical system includes a display, and wherein said display is a digital display and said electrical system further includes a processing unit and a communication interface, said processing unit controlling the communication interface and the display, said processing unit being adapted to communicate, via the communication interface, with a remote source of information to retrieve information for displaying said information on the display.

21. The sunshade according to claim 20, wherein said sunshade is installed at a public transportation station and said information includes timing of arrival and/or departure of public transportation vehicles at said public transportation station.

22. A sunshade for an outdoor public space having a ground, said sunshade including:

a pane adapted to provide at least partial shade from sunlight;

a pivotal mount adapted to be fixed to the ground and pivotally supporting said pane so that said pane is orientable by rotation about an axis of rotation which is substantially vertical when said pivotal mount is fixed to the ground, wherein said pane is of substantially elongate shape, with a height extending longitudinally, substantially parallel to the axis of rotation, between a lower end and an upper end, wherein said pane has a width and a thickness which are perpendicular to the axis of rotation, the greatest thickness being smaller than the greatest width, wherein said sunshade is configured to enable a user standing on the ground to come in immediate vicinity to said pane, the sunshade further having a wall which extends from substantially said upper end of said pane and which is adapted to protect a user from weather, said wall being either substantially horizontal or inclined.

23. The sunshade according to claim 22, further including lateral walls extending from said pane under said wall to protect a user from weather.

* * * * *